US005902974A

United States Patent [19]

Fogle et al.

[11] Patent Number: 5,902,974

[45] Date of Patent: May 11, 1999

[54] SLIDE BAR INTERLOCK

[75] Inventors: Thomas K. Fogle, Shaler Township; John J. Henwood, Beaver; Anthony T. Ricciuti, Mt. Lebanon, all of Pa.

[73] Assignee: Eaton Corporation, Cleveland, Ohio

[21] Appl. No.: 08/998,873

[22] Filed: Dec. 29, 1997

[51] Int. Cl.[6] ..... H01H 9/26

[52] U.S. Cl. ..... 200/50.33; 200/5 B; 200/43.16

[58] Field of Search ..... 200/50.33, 50.32, 200/50.35, 50.36, 43.16, 43.18, 43.19, 5 B, 5 E, 5 EA, 5 EB

[56] References Cited

U.S. PATENT DOCUMENTS

| | | | |
|---|---|---|---|
| 3,267,223 | 8/1966 | Larkin | 200/5 B |
| 4,286,242 | 8/1981 | Mrenna et al. | 335/160 |
| 4,517,422 | 5/1985 | Black, III et al. | 200/5 E |
| 5,130,501 | 7/1992 | Maeda | 200/50.33 |

OTHER PUBLICATIONS

Cutler Hammer, I.L. 29–858B, pp. 1–4 (Jun. 1997).
Westinghouse, I.L. 15532, pp. 1–2 (Nov. 1986).

*Primary Examiner*—Renee S. Luebke
*Attorney, Agent, or Firm*—Martin J. Moran

[57] ABSTRACT

A slide bar interlock for interlocking adjacent first and second circuit breakers having dissimilar actuating means and preventing the first and second circuit breakers from simultaneously being in a closed operating position. The slide bar interlock includes a housing and a slide bar received in the housing. The slide bar includes a first end which extends from the housing adjacent to the first circuit breaker and a second end which extends from the housing adjacent to the second circuit breaker. The slide bar is slidable between a first position where the first end of the slide bar blocks operation of a pivoting actuating handle of the first circuit breaker and a second position where the second end of the slide bar maintains a push-to-open button of the push button actuating means of the second circuit breaker in an actuated position. The second end of the slide bar includes a pin member which is received in a transverse aperture formed in the push-to-open button for maintaining the push-to-open button in the actuated position.

8 Claims, 3 Drawing Sheets

SLIDE BAR INTERLOCK

BACKGROUND OF THE INVENTION

1. Field of the Invention

This invention relates generally to an apparatus for interlocking adjacent circuit breakers having dissimilar actuating means so as to prevent the circuit breakers from simultaneously being in a closed operating position.

2. Background Information

There are a number of applications where it is required that the operation of two circuit breakers be coordinated such that only one circuit breaker can be in the closed or "on" operating position at a time. One such application is providing a load with electrical power from either of two different sources, such as for example, a commercial power system and an auxiliary supply. It is imperative in such applications that only one circuit breaker be in the closed operating position at a time to preclude interconnecting the two different sources. For this particular application, as well as other applications, it is known to provide an interlock to prevent the circuit breakers from simultaneously being in the closed operating position.

One such interlock, disclosed in U.S. Pat. No. 4,286,242, is designed specifically for use with circuit breakers and utilizes plungers which engage the internal operating mechanisms of the circuit breakers. This interlock provides for the circuit breakers to be aligned end-to-end and to be similar type circuit breakers with the same type of actuating means for actuating the internal operating mechanisms.

Other interlocks are known which couple the actuating means, e.g., operating handles, of the circuit breakers whose operation is to be coordinated.

Typically the circuit breakers and the type of actuating means employed by the circuit breakers are similar, if not identical, allowing for a somewhat symmetrical interlock device to be employed. However, we are not aware of any such interlock which is capable of interlocking circuit breakers having dissimilar actuating means.

There is a need, therefore, for an interlock overcoming the above described limitations and disadvantages of the prior art.

There is also a need for an interlock which prevents adjacently positioned circuit breakers having dissimilar actuating means from simultaneously being in a closed or "on" operating position.

There is a need for an interlock which may be utilized with existing circuit breaker designs with minimal or no modifications to the existing circuit breakers.

There is a further need for an interlock which provides a visual indication of which circuit breaker is in the closed or "on" operating position and which breaker is locked-off, i.e., in the open or "off" operating position.

SUMMARY OF THE INVENTION

These and other needs are satisfied by the present invention which is directed to a slide bar interlock for interlocking adjacent first and second circuit breakers having dissimilar actuating means so as to prevent the first and second circuit breakers from simultaneously being in a closed or "on" operating position. The first and second circuit breakers may be of types that are generally known with the first circuit breaker, for example, being a molded case circuit breaker having a pivoting actuating handle and the second circuit breaker, for example, being a systems power breaker having a push button actuating means including a push-to-open button and a push-to-close button.

The slide bar interlock includes a housing means and a slide bar which is received in the housing means. Preferably, the housing means is positioned between the adjacently located first and second circuit breakers. This allows for a first end of the slide bar to extend from the housing means and be positioned adjacent the pivoting actuating handle of the first circuit breaker. Similarly, a second end of the slide bar extends from the housing means and is positioned adjacent the push button actuating means of the second circuit breaker.

The slide bar is slidable between a first position and a second position. When the slide bar is located in the first position, the first end of the slide bar blocks operation of the pivoting handle of the first circuit breaker. Similarly, when the slide bar is located in the second position, the slide bar maintains the push-to-open button of the push button actuating means in an actuated position.

The second end of the slide bar preferably includes a pin member which engages the push-to-open button when said slide bar is in the second position and when the push-to-open button is in the actuated position. Advantageously, this maintains the push-to-open button in the actuated position and prevents the circuit breaker from being placed in the closed operating position. In a preferred embodiment, this is accomplished by the push-to-open button of the second circuit breaker extending generally outwardly from the second circuit breaker and having a transverse aperture formed therein. When the slide bar is placed in the second position, the pin member is then received in the transverse aperture when the push-to-open button is in the actuated position so as to maintain the push-to-open button in the actuated position.

In a further embodiment, a support member, such as a hub, may be mounted to the second circuit breaker adjacent the push-to-open button. The hub includes a hole aligned with the transverse aperture of the push-to-open button such that the pin member is received in the hole and the transverse aperture when the push-to open button is in the actuated position. This also effectively maintains the push-to-open button in the actuated position.

As a further means for preventing the second circuit breaker from being placed in the closed operating position, the second end of the slide bar also may block access to the push-to-close button of the push button actuating means when the slide bar is in the second position. By blocking access to the push-to-close button, actuation of the push-to-close button is prevented.

The second circuit breaker may also include a manual charge handle positioned adjacent to the push-to-open button and the push-to-close button. Advantageously, the second end of the slide bar may be configured so as to block movement of the manual charge handle when the slide bar is in the second position so as to prevent operation thereof.

BRIEF DESCRIPTION OF THE DRAWINGS

A full understanding of the invention can be gained from the following description of the preferred embodiments when read in conjunction with the accompanying drawings in which.

DESCRIPTION OF THE PREFERRED EMBODIMENT

Figure 1:
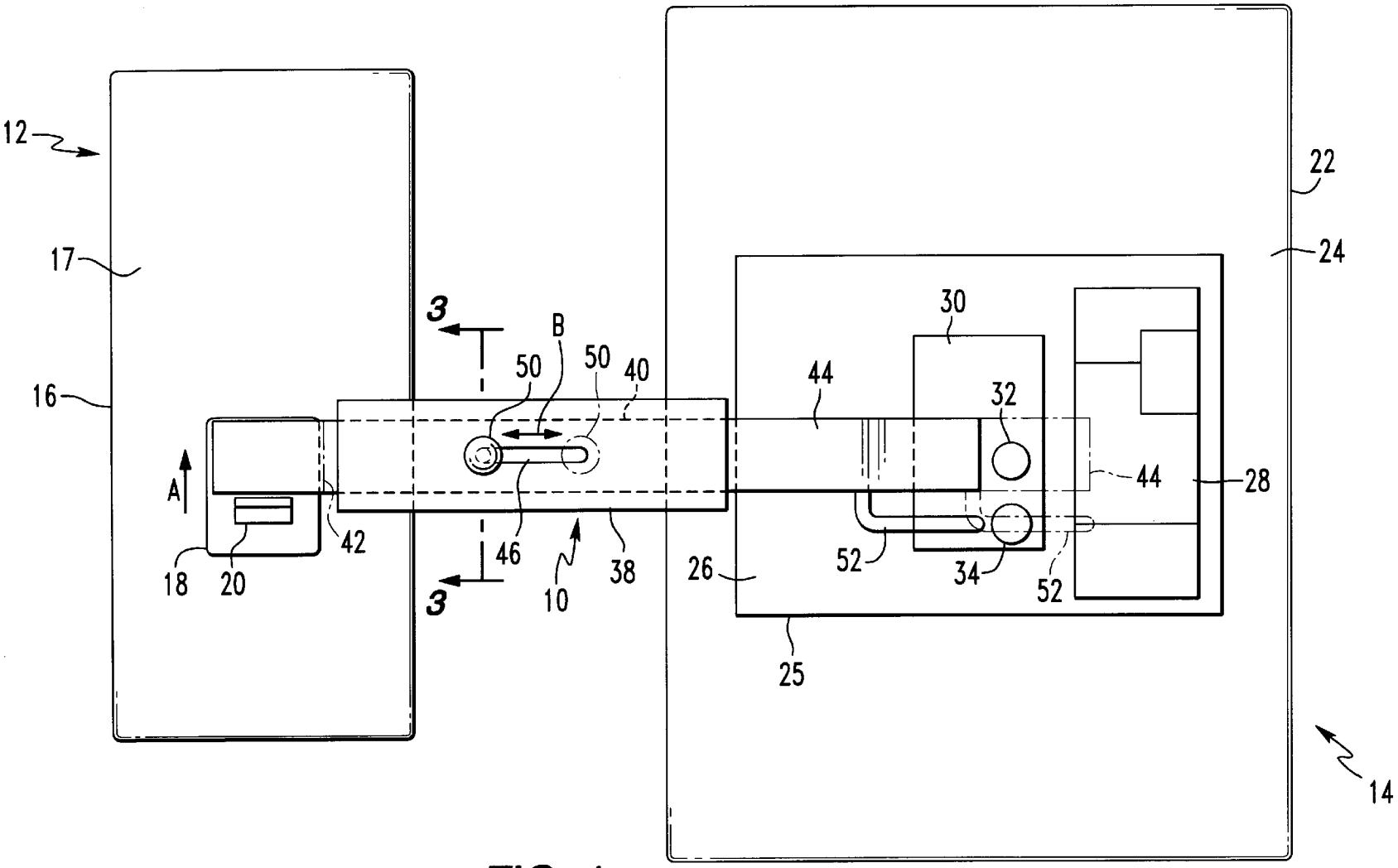
FIG. 1 is a front view showing a slide bar interlock of the present invention as mounted for interlocking circuit breakers having dissimilar actuating means.
Figure 2:
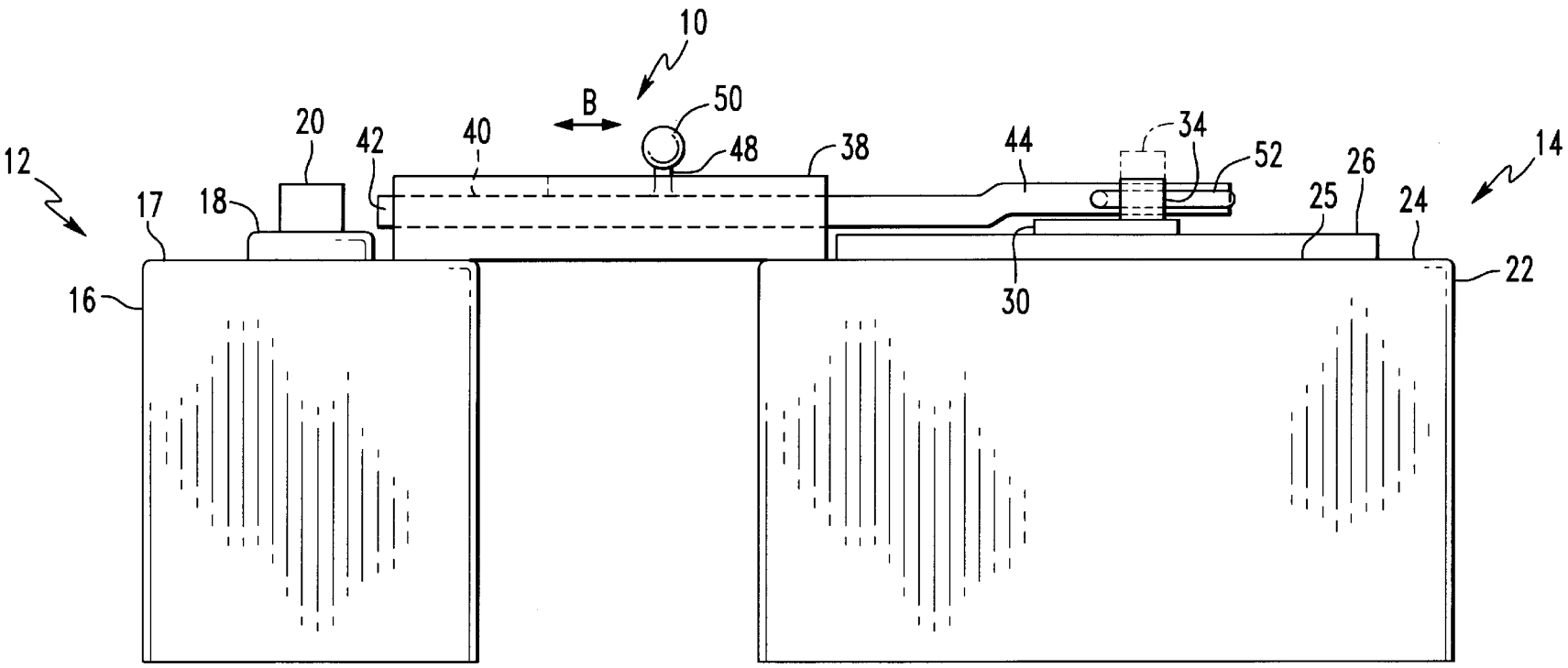
FIG. 2 is a side view showing the slide bar interlock of the present invention as mounted for interlocking the circuit breakers having dissimilar actuating means.

Referring to FIGS. 1 and 2, there is shown a slide bar interlock 10 of the present invention for interlocking adjacently positioned first circuit breaker 12 and second circuit breaker 14. The first and second circuit breakers 12, 14 may be of types that are generally known in the art with the first circuit breaker 12, for example, being a molded case circuit breaker and the second circuit breaker 14, for example, being a systems power breaker. The first circuit breaker 12 includes a housing 16 having a front surface 17 with a raised escutcheon 18 formed thereon. A pivoting actuating handle 20 extends upwardly through the raised escutcheon 18 so as to provide for manual operation of the operating mechanism contained within the first circuit breaker 12, as is known. The pivoting actuating handle 20, as shown in FIG. 1, is in the "off" position so that the first circuit breaker 12 is in an open operating position. The pivoting actuating handle 20 may be pivoted in the direction of arrow A in order to place the pivoting actuating handle 20 in an "on" position which results in the first circuit breaker 12 being in a closed operating position.

Figure 4:
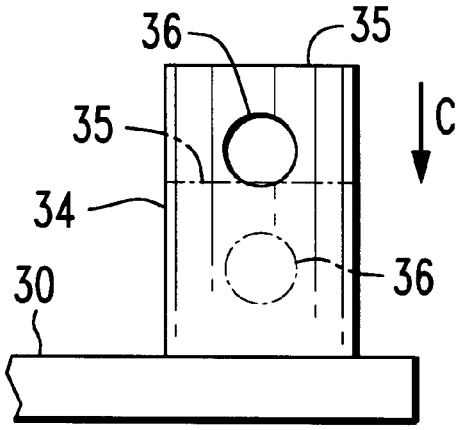
FIG. 4. is a side view of a push-to-open button for use in association with the slide bar interlock of the present invention.

The second circuit breaker 14 includes a housing 22 having a front panel 24. The front panel includes a wall 25 forming an opening 26. Mounted within the opening 26 is a manual charge handle 28, as is known. Also in opening 26 is a raised platform 30 on which is mounted a push-to-close button 32 and a push-to-open button 34. As is known, actuation of the push-to-close button 32 places the second circuit breaker 14 in the "on" or closed operating position. Preferably, the push-to-open button 34 extends generally outwardly from the raised platform 30 and includes a transverse aperture 36 formed therein (see FIG. 4). Actuation of the push-to-open button 34 operates the second circuit breaker 14 to the "off" or open operating position.

Figure 3:
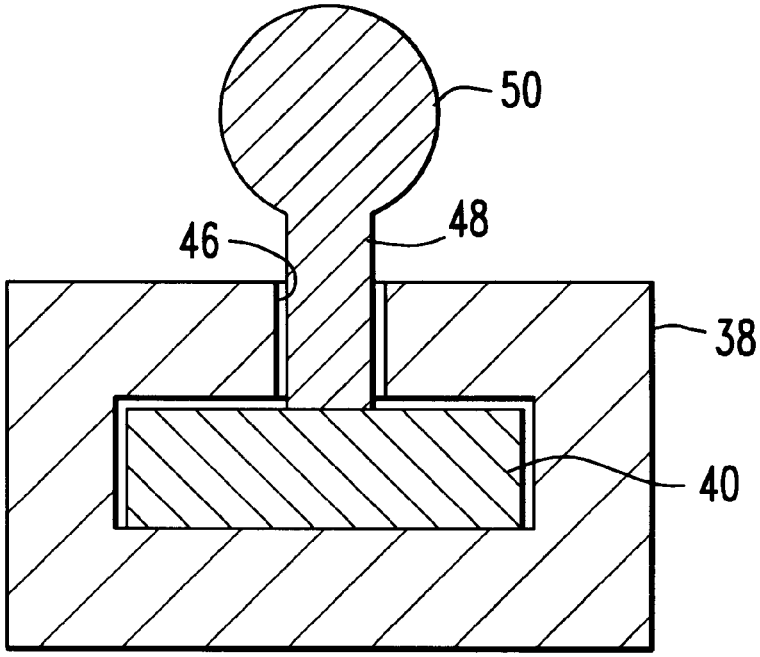
FIG. 3 is an enlarged sectional view taken along line 3–3 of FIG. 1.

The slide bar interlock 10 includes a housing means, such as housing 38, and a slide bar 40 which is received in the housing 38 (see FIG. 3). The housing 38 may be positioned so as to span between the front surface 17 of the first circuit breaker 12 and the front panel 24 of the second breaker 14. It will be appreciated that housing 38 may be as shown, rectangular in shape and essentially fully enclosing the slide bar 40, or may be any other suitable shape or configuration, such as, for example Ushaped, so as to effectively provide for housing the slide bar 40 and mounting the slide bar 40 between the circuit breakers 12, 14 in order to carry out the present invention. The slide bar 40 includes a first end 42 extending from the housing 38 so as to be positioned adjacent the first circuit breaker 12. The slide bar 40 also includes a second end 44 which extends from the housing 38 so as to be positioned adjacent the second circuit breaker 14. An elongated slot 46 may be formed in the housing 38 through which extends an arm 48 which is connected to the slide bar 40. Arm 48 includes a knob 50 so that the slide bar 40 may be slid, as indicated by arrow B, between a first and second position, as will be described in more detail herein.

As shown in FIG. 1, when the slide bar 40 is slid to the first position, the first end 42 of the slide bar 40 blocks operation of the pivoting actuating handle 20 of the first circuit breaker 12. As can be appreciated, this maintains the pivoting actuating handle in an open operating position. With the second end 42 of the slide bar 40 blocking the pivoting actuating handle 20, the pivoting actuating handle 20 is prevented from being placed in the closed operating position. As can be further appreciated, this allows for the second circuit breaker 14 to be placed in the closed operating position without the possibility of the first circuit breaker 12 also being in the closed operating position.

As shown in FIG. 2 and in phantom line in FIG. 1, sliding the second end 44 of the slide bar 40 to the second position results in the slide bar 40 maintaining the push-to-open button 34 of the second circuit breaker 14 in an actuated position. Specifically, push-to-open button 34 is actuated by, for example, depressing the push-to-open button 34 downwardly as indicated by arrow C in FIG. 4. As described, actuation of the push-to-open button 34 results in the second circuit breaker 14 being placed in an open operating position. Therefore, as long as the push-to-open button 34 is maintained in the actuated position, the second circuit breaker 14 is prevented from being in the closed operating position. Thus, in order to maintain the push-to-open button 34 in an actuated position, the second end 44 of the slide bar 40 includes a pin member 52 which engages the push-to-open button 34, and preferably extends through the transverse aperture 36 formed in the push-to-open button 34 when the slide bar 40 is in the second position. As can be appreciated, actuation of the push-to-open button 34 results in the pin member 52 and the transverse aperture 36 being in alignment for receipt of pin member 52 therein. Advantageously, this allows for the second circuit breaker 14 to be maintained in the open operating position while allowing for the pivoting actuating handle 20 of the first circuit breaker 12 to be pivoted to the closed operating position. Of course, this is possible as a result of the first end 42 of the slide bar 40 no longer blocking operation of the pivoting actuating handle 20 once the slide bar 40 is placed in the second position.

It will be appreciated that the slide bar 40 has a sufficient length so as to always be blocking operation of the pivoting actuating handle 20 or maintaining the push-to-open button 34 in an actuated position. This ensures that circuit breakers 12, 14 are never simultaneously in the closed operating position.

In accordance with another aspect of the present invention, the second end 44 of the slide bar 40 blocks access to the push-to-close button 32 when the slide bar 40 is in the second position. Advantageously, this prevents actuation of the push-to-close button 32 and provides further assurance that the second circuit breaker 14 remains in the open operating position. Also, as shown in FIG. 1, the second end 44 of the slide bar 40 blocks movement of the manual charge handle 28 when the slide bar 40 is in the second position. This prevents operation of the manual charge handle 28 and provides even further assurance that the second circuit breaker 14 remains in the open operating position. A portion of the pin member 52 may also block movement of the manual charge handle 28 to further prevent operation thereof.

Figure 5:
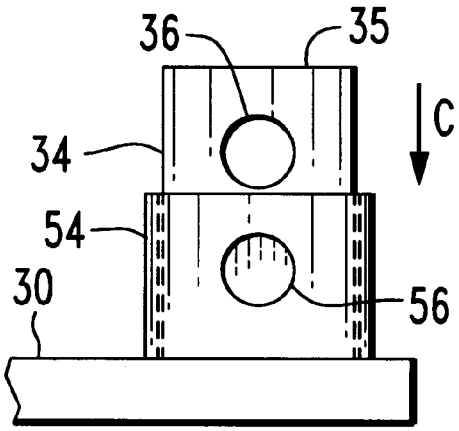
FIG. 5. is a side view of another embodiment of a push-to-open button for use in association with the slide bar interlock of the present invention.

FIG. 5 shows another embodiment where the push-to-open button 34 is received within a support member, such as a hub 54 which is mounted to the raised platform 30 of the second circuit breaker 14 and disposed about the push-to-open button 34. The hub 54 includes a hole 56 which becomes aligned with the transverse aperture 36 once the push-to-open button is in the actuated position. The pin member 52 is then received in the hole 56 and the transverse aperture 36 when the slide bar 40 is in the second position. As can be appreciated, this also maintains the push-to-open button 34 in the actuated position and provides further structural support to the push-to-open button 34 and the pin member 52 which extends therethrough.

Of course, it will be appreciated that other arrangements for maintaining the push-to-open button 34 in the actuated position using pin member 52 may be employed in accordance with the concept of the present invention. For example, the pin member 52 may bear directly against a top surface 35 of the push-to-open button 34 when the slide bar 40 is in the second position and when the push-to-open button 34 is in the actuated position maintaining the push-to-open button 34 in the actuated position. Alternatively, a push button extension, as is known, may be provided for a push-to-open button that is configured flush with the raised platform 30 with the push button extension being configured, for example, to include a transverse aperture for receiving the pin member 52, as described herein.

While specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of invention which is to be given the full breadth of the claims appended and any and all equivalents thereof.

What is claimed is:

1. In combination:

a first circuit breaker;

said first circuit breaker having a first actuating means;

a second circuit breaker;

said second circuit breaker positioned adjacent said first circuit breaker, said second circuit breaker having a second actuating means dissimilar from said first actuating means of said first circuit breaker;

interlocking means for interlocking said first and second circuit breakers and preventing said first and second actuating means from simultaneously being in a closed operating position;

wherein said interlocking means comprises:

a housing means;

a slide bar received in said housing means;

said slide bar having a first end extending from said housing means adjacent the first circuit breaker and a second end extending from said housing means adjacent the second circuit breaker;

said slide bar being slidable between a first position in which said first end of said slide bar blocks operation of said first actuating means of the first circuit breaker and a second position in which said second end of said slide bar maintains said second actuating means of the second circuit breaker in an actuated position; and wherein said first actuating means includes a pivoting handle, said first end of said slide bar blocking operation of said pivoting handle when said slide bar is in the first position.

2. In combination:

a first circuit breaker;

said first circuit breaker having a first actuating means;

a second circuit breaker;

said second circuit breaker positioned adjacent said first circuit breaker, said second circuit breaker having a second actuating means dissimilar from said first actuating means of said first circuit breaker;

interlocking means for interlocking said first and second circuit breakers and preventing said first and second actuating means from simultaneously being in a closed operating position;

wherein said interlocking means comprises:

a housing means;

a slide bar received in said housing means;

said slide bar having a first end extending from said housing means adjacent the first circuit breaker and a second end extending from said housing means adjacent the second circuit breaker;

said slide bar being slidable between a first position in which said first end of said slide bar blocks operation of said first actuating means of the first circuit breaker and a second position in which said second end of said slide bar maintains said second actuating means of the second circuit breaker in an actuated position; and wherein said second actuating means includes a push-to-open button, said second end of said slide bar maintaining said push-to-open button in the actuated position when said slide bar is in the second position.

3. The combination of claim 2 wherein said second actuating means further includes a push-to-close button adjacent said push-to-open button, said second end of said slide bar blocking access to the push-to-close button when said slide bar is in the second position so as to prevent actuation of the push-to-close button.

4. The combination of claim 3 wherein said second circuit breaker also includes a manual charge handle adjacent said push-to-open button and said push-to-close button, said second end of said slide bar blocking movement of said manual charge handle when said slide bar is in the second position so as to prevent operation of the manual charge handle.

5. The combination of claim 2 wherein said second end of said slide bar includes a pin member which engages said push-to-open button when said slide bar is in the second position and when said push-to-open button is in the actuated position so as to maintain the push-to-open button in the actuated position.

6. The combination of claim 5 wherein said push-to-open button extends generally outwardly from said second circuit breaker and includes a transverse aperture formed therein, said pin member being received in said transverse aperture when said slide bar is in the second position and when said push-to-open button is in the actuated position so as to maintain the push-to-open button in the actuated position.

7. The combination of claim 6 wherein said second actuating means further includes a support member mounted to said second circuit breaker adjacent said push-to-open button, said support member having a hole aligned with said transverse aperture of said push-to-open button, said pin member being received in said hole and said transverse aperture when said slide bar is in the second position and when said push-to-open button is in the actuated position so as to maintain the push-to-open button in the actuated position.

8. The combination of claim 7 wherein said support member is a hub disposed about the push-to-open button.

* * * * *